United States Patent [19]

Tobler

[11] Patent Number: 4,748,568

[45] Date of Patent: May 31, 1988

[54] APPARATUS FOR DRAWING IN WARP THREADS INTO A HARNESS

[75] Inventor: Hans Tobler, Zelg-Wolfhalden, Switzerland

[73] Assignee: G. Bopp & Co. AG, Metallgewebe-und Drahtwarenfabrik, Zurich, Switzerland

[21] Appl. No.: 836,169

[22] PCT Filed: May 30, 1985

[86] PCT No.: PCT/CH85/00087

§ 371 Date: Jan. 13, 1986

§ 102(e) Date: Jan. 13, 1986

[87] PCT Pub. No.: WO86/00346

PCT Pub. Date: Jan. 16, 1986

[30] Foreign Application Priority Data

Jun. 18, 1984 [CH] Switzerland ..... 2945/84

[51] Int. Cl.[4] ..... D03J 1/14

[52] U.S. Cl. ..... 364/470; 28/204

[58] Field of Search ..... 364/468, 470; 28/185, 28/203, 204, 206, 207, 208

[56] References Cited

U.S. PATENT DOCUMENTS

| | | | |
|---|---|---|---|
| 3,072,999 | 1/1963 | Cook et al. | 28/204 |
| 4,141,120 | 2/1979 | Schank | 28/185 |
| 4,233,716 | 11/1980 | Patel | 28/207 |

*Primary Examiner*—Jerry Smith
*Assistant Examiner*—John R. Lastova
*Attorney, Agent, or Firm*—Ladas & Parry

[57] ABSTRACT

The apparatus comprises a slide (1) with a sley hook (5) reciprocally movable transversely to the slide path which after each step of the slide is automatically advanced into a reed space of the harness (4) disposed parallel to the slide path and is withdrawn after hooking in the warp thread. The step length of the slide (1) is exactly identical to the individual reed spacing which is optically sensed by a television camera (12) and is measured respectively calculated by an electronic equpment (16, 17, 18, 19). This continuous touchfree measurement of the reed spacing enables a faultless reading even on finest reeds, without the disadvantages of a mechanical sensing of the harness.

5 Claims, 2 Drawing Sheets

APPARATUS FOR DRAWING IN WARP THREADS INTO A HARNESS

Figure 1:
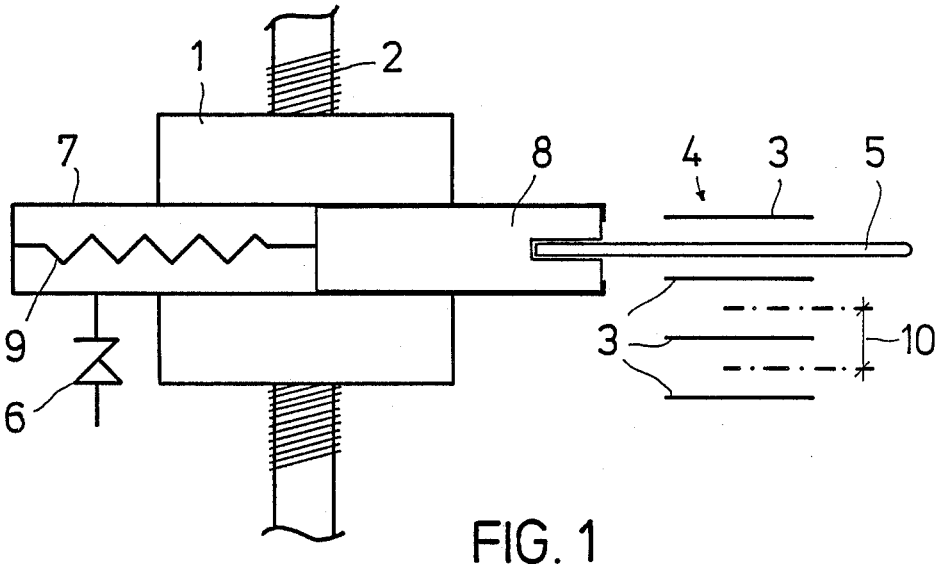

The invention refers to an apparatus for drawing in warp threads into a harness, with a slide stepwise movable along the harness, the steps corresponding to the reed space. A sley hook is mounted on the slide and is longitudinally movable in a direction transverse to the slide path. The sley hook can be advanced automatically after each step of the slide into the reed space between two adjacent divisions of a harness to be disposed parallel to the slide path and, after securing the warp thread, withdrawn again.

In an article with the heading "New Method of Reeding for Very Fine Reeds in Metal and Textil Cloth Weaving", written by C. Th. Schreus in the review "mittex", no. 8/1976, an apparatus of the above kind is described on which the charging of each reed space by a warp thread is secured by the fact that the sley hook during insertion of the warp thread into the harness is not fully withdrawn from the plane of the latter. During the stepwise advance of the slide the sley hook passes through a notch in one division of a reed to the following dent against which it strikes. The notches of adjacent divisions are staggered with regard to each other and are sensed individually by the sley hook which is pivotable within the reed space. In this way an omission of a reed space can be avoided, enabling thus a faultless insertion even with the finest reeds.

This mechanical sensing has certain disadvantages. On one hand the manufacturing of the harness is made difficult and substantially rendered more expensive by the insertion of the notches onto the reed divisions and by the controlled assembling of the reed divisions with staggered notches. In addition the notches may impair the function of the harness as an element intended for being striked by the weft thread. Increased wear of the reed divisions is also to be taken into consideration. Finally, the sensing operation of the sley hook calls for supplementary devices on the apparatus.

As to the mechanical sensing referred to it is possible to take care of variations in the reed spacing in such a way that the lateral pressure of the sley hook on the reed divisions is monitored and the advance of the slide is corrected upon changes in that pressure. This kind of control, however, further increases the need for additional devices, and in addition on increases the susceptibility of the device to problems due to the multiple function of the sley hook and the complicated mechanical control devices associated therewith.

The object of the present invention is to develop an apparatus for inserting warp threads into a harness on which the displacement of the slide is controlled in dependency of the varying reed spacing and an apparatus which does not have the disadvantages referred to above.

The exact, step-by-step displacement of the slide represents a particular problem. This displacement is aggravated by the fact that the reed spacing across the width of the harness is not always constant, due to reasons of manufacturing. If the step distance of the slide were constant, but the reed spacing would vary, then drawing-in troubles would be unavoidable.

In order to solve this task, the apparatus according to the present invention is characterized by means for continuously touch-free measument of the reed spacing, means for determining the distance between the center of the reed space occupied by the sley hook and the center of the following reed space, and means for controlling the advance of the slide in step lengths according to the determined distances of the reed space centers.

A preferred embodiment of the invention consists in that a television camera is attached to the slide and views always a part of the sley hook, and that there is provided an electronic device that digitalizes the analog signals received from the camera by means of an analog-digital converter. The electronic digital device breaks up binarily the digital image displayed on a monitor into image points on a longitudinal axis of said monitor, counts with a calculating device the subsequent series of bright and dark image points, covers the transitions from bright to dark and from dark to bright and calculates on the basis of this information and by means of an image scale preset by input equipment the respective distances of the centers of the reed spaces. With this information it generates control signals for the stepwise advance of the slide. In this manner a precise control of the slide depending on the variable reed spacing is possible. And, all by using relatively simple electronic means which are per se known.

Preferably the control of the harness drive is coupled with the one of the slide advance drive so that each working step of the apparatus begins with the withdrawal of the sley hook from a reed spacing and ends with the advance of the sley hook into the adjacent reed space. Between these steps the warp thread is always hooked onto the hook section of the sley hook. Preferably there is provided a switch operable by hand or by foot for initiating each working step of the apparatus. In this manner the operational speed of the apparatus, during manual hooking of the warp thread, can be adapted to that of the operator.

On the slide, a device for precisely adjusting the lateral displacement of the sley hook can be provided so that the position of the sley hook is adjustable with regard to the image center point.

The invention will be further explained by means of the drawings which represent a preferred embodiment. In these drawings FIG. 1 represents a partial top view of the slide and the harness, FIG. 2 is a side view in a larger scale of the harness and parts of the television camera and the sley hook, and FIG. 3 discloses a schematic representation of the apparatus with the electronic equipment.

FIG. 1 represents schematically a slide 1 which is movable along a threaded bar 2, as well as some divisions 3 of the harness disposed parallel to threaded bar 2. On slide 1 a sley hook 5 is supported and longitudinally moveable in a direction transverse to the slide path. Sley hook 5 is reciprocally moved by a working cylinder 7 operated e.g. pneumatically via a valve 6. Piston 8 of the working cylinder 7 carries on one end sley hook 5 whereas on its other end a retracting spring 9 is attached. Slide 1 is moved step by step, with sley hook 5 in a withdrawn position, according to reed spacing 10, sley hook 5 being advanced after each step of slide 1 by means of working cylinder 7 into the reed space between two adjacent reed divisions 3 and withdrawn after hooking in the warp thread. The latter is drawn through the respective reed space upon withdrawal of sley hook 5 and then released in a manner not represented, e.g. mechanically, out of the sley hook.

Figure 2:
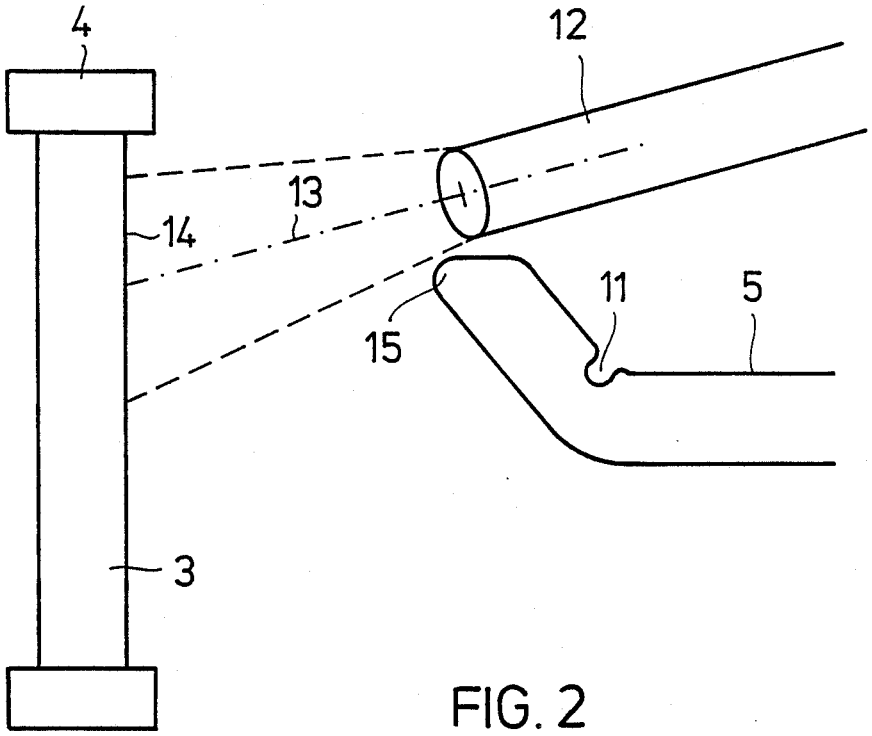
Figure 3:
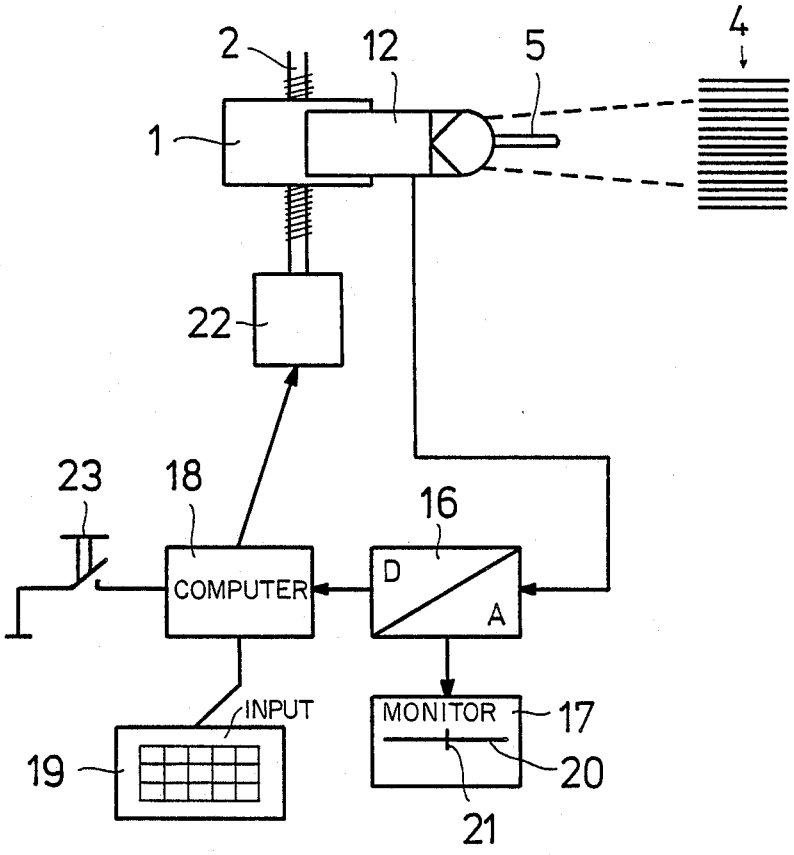

FIG. 2 represents in a side view harness 4 with reed divisions 3 and sley hook 5 with hook groove 11 for hooking up the warp thread.

According to FIG. 2 a television camera 12 is provided above the sley hook, mounted on slide 1 in a manner not illustrated. This camera 12 covers optically a part of harness 4 whereby it is sufficient for the intended purpose to have but few reed dents 3 within the field of vision of television camera 12. In order to cover, when working with harnesses of different reed spacings, always about the same number of divisions by the television camera, there are preferably means provided for altering the image scale. Such means are known per se and need not be further described herein. Center axis 13 of television camera 12 should meet plane 14 of harness 4 in a height in which tip 15 of sley hook 5 meets that plane when advancing. In this way one obtains a measurement of the reed spacing at a location on which sley hook 5 later penetrates harness 4 and it is also assured that the advanced sley hook 5 is covered by television camera 12. This last mentioned fact is of particular importance when setting the initial position of slide 1. When selecting the height referred to, it must be taken into consideration that the possible variations of the reed spacing in the region of the reed dent ends are as a rule smaller than in the middle region of the latter where finest reed divisions may even stick together. It is therefore recommended to preferably work in the end regions of the reed divisions.

Not illustrated is a device which canbe provided on slide 1 for precisely adjusting the 1 lateral displacement of sley hook 5, in order to adjust the position of sley hook 5 with regard to the image center point respectively to the vertical plane laid through center axis 13 of television camera 12.

The electronic equipment for measuring the reed spacing and for calculating the distance between centerlines of adjacent reed spaces comprises an analog-digital converter 16, a monitor 17, a computer 18 and input equipment 19 for presetting the image scale. The analog image signals supplied by television camera 12 are converted in the analog-digital converter 16 into digital signals which are fed to monitor 17 and computer 18. The digital image covered by the monitor is sensed in a longitudinal axis 20 of the latter, i.e. in a horizontal image direction and broken up binarily into a certain number of image points. Consecutive series of bright image points (reed spaces) and dark image points (reed divisions) are counted by computer 18 whereby the transitions from bright to dark and from dark to bright are covered. Based on this information and on the preset image scale, the computer, starting from the image center represented by a mark 21 on monitor 17, determines consecutively, in the sequence of the steps of slide 1, the subsequent reed spacings 10. If mark 21 is initially set on the center of the first reed space of harness 4 displayed on monitor 17, the calculation yields exactly the distance between the center of the reed space actually occupied by sley hook 5 and the center of the following reed space.

On the exit of computer 18 control signals are supplied for controlling the slide advance in step length according to the calculated distances between reed space centers. These control signals are fed to a step motor 22 respectively, a d.c. motor, with an incremental emitter which drives threaded bar 2 for advancing slide 1.

Prior to starting the apparatus, slide 1 is moved into an initial position in which sley hook 5 faces the first reed space of harness 4 and in which mark 21 on monitor 17 appears in the center of the digital image of that reed space. Then sley hook 5 is advanced into this first reed space.

After hooking the first warp thread the apparatus can be started which is accomplished by actuating switch 23 either by hand or foot. Due to this actuation the apparatus conducts a working step which consists in that sley hook 5 is first withdrawn and the warp thread carried along with it is released thereafter. Slide 1 is then displaced by the reed spacing determined by the electronic equipment and sley hook 5 is advanced in the subsequent reed space. For achieving this working step the control of working cyliner 7 is coupled to the one of step motor 22 in a, not represented manner. Each further working step of the apparatus is always initiated by actuating switch 23.

I claim:

1. Apparatus for drawing warp threads into a harness having a plurality of division means, said apparatus comprising:

a slide movable generally perpendicularly stepwise of said division means such that said slide can be located generally opposite of the center defined between any two of said division means;

a sley hook slidably mounted to said slide and movable generally perpendicular of said slide and parallel of said division means such that said sley hook can be advanced between said division means and then withdrawn therefrom when said slide is located generally opposite said centers defined between any two of said division means;

electro-optical means for sequentially and continuously measuring the distance between said division means to control the step movement of said slide such that said sley hook may be advanced between said division means.

2. The apparatus of claim 1 wherein said electro-optical means is comprised of:

a camera attached to said slide for continuously viewing at least a part of said sley hook and transmitting an analogue signal associated with said sley hook and said division means;

an analogue digital means for receiving said analogue signal and converting it to a digital signal;

a monitor for displaying along an axis said digital signal;

a calculating means for reading said digital signal and calculating the distance between like signals to determine the centers defined between said division means; and control means for receiving the calculations of said calculating means and moving said slide accordingly.

3. Apparatus according to claim 2, further comprising means for precisely adjusting the displacement of the sley hook so that the position of the sley hook is adjustable with regard to the central image point of said camera.

4. The apparatus of claim 2 wherein each step movement of said slide begins with the withdrawing of said sley hook from the area defined between any two division means and ends with the advance of said sley hook into the adjacent area defined by the division means.

5. Apparatus according to claim 4, further comprising a switch operable by hand or by foot for initiating each step movement of said slide.

* * * * *